United States Patent [19]

Johns

[11] Patent Number: 5,044,357

[45] Date of Patent: Sep. 3, 1991

[54] APPARATUS FOR INCREASED VOLUME HYDROTHERAPY

[76] Inventor: C. Richard Johns, 2800 Shady Tree La., Edmond, Okla. 73013

[21] Appl. No.: 409,089

[22] Filed: Sep. 19, 1989

[51] Int. Cl.[5] ..... A61H 9/00

[52] U.S. Cl. ..... 128/66; 4/543

[58] Field of Search ..... 128/65, 66, 62; 4/158

[56] References Cited

U.S. PATENT DOCUMENTS

| | | | |
|---|---|---|---|
| 2,113,253 | 4/1938 | Gray | 128/299 |
| 2,272,481 | 2/1942 | Rinkes et al. | 128/66 |
| 3,772,714 | 11/1973 | Sealby et al. | 4/179 |
| 3,837,334 | 9/1974 | Johnson | 128/24.3 |
| 4,090,507 | 5/1978 | Van Horn | 128/66 |
| 4,099,522 | 7/1978 | Alenares | 128/66 |
| 4,149,529 | 4/1979 | Copeland et al. | 128/24.1 |
| 4,466,141 | 8/1984 | Starkey | 128/66 |
| 4,620,529 | 11/1986 | Kurosawa | 128/66 |
| 4,670,010 | 6/1987 | Dragone | 604/289 |
| 4,800,046 | 1/1989 | Malek et al. | 128/66 |

*Primary Examiner*—Stephen C. Pellegrino
*Assistant Examiner*—Michael Rafa
*Attorney, Agent, or Firm*—Laney, Dougherty, Hessin & Beavers

[57] ABSTRACT

A foot and leg hydrotherapy apparatus consisting of a housing forming a well that is adapted to receive a user's feet and lower legs. The inner walls of the well have a plurality of precisely directed jets that provide an adjustable air/water jet spray on each foot and leg of the subject. A separate drain motor is utilized for evacuating water from the system.

5 Claims, 2 Drawing Sheets

APPARATUS FOR INCREASED VOLUME HYDROTHERAPY

BACKGROUND OF THE INVENTION

1. Field of the Invention.

The invention relates generally to whirlpool devices and, more particularly, but not by way of limitation, it relates to an improved high volume hydrotherapy apparatus that is particularly adapted for foot and leg stimulation.

2. Description of the Prior Art.

The prior art includes various types of hydrotherapy devices using jet directed water and a number of such general types of device are employed for foot and leg hydrotherapy. U.S. Pat. No. 3,837,334 discloses a foot spa cabinet for bathing and exercising the legs and feet under a spray of hot water. This device sprays water upward against the soles of the feet and inward against the outer ankles while also providing a foot roller for stimulation of the foot insteps. U.S. Pat. No. 4,620,529 teaches yet another type of foot bath wherein a spray/-wash-over bath is combined with a foot vibrator that functions against the soles of the feet. The water application is a general hot water spray emanating from the forward wall of the bath container.

U.S. Pat. No. 4,099,522 discloses a hydrotherapy apparatus with a bath container having specifically directed water jets that strike the calves and instep areas of the feet while utilizing contrasting water temperature changes to effect certain muscle reaction. The water temperature variation is a primary aspect of this teaching. Finally, U.S. Pat. No. 4,090,507 provides teaching of a tank for use in a form of hydrotherapy wherein body part elevation and positioning is instrumental and wherein heated water is used in a wash-over mode to effect more gentle stimulation.

SUMMARY OF THE INVENTION

The present invention relates to an improved hydrotherapy construction wherein much increased volume of water/air is jet directed at specific areas about the feet and lower legs. The device is a recirculating type of unit wherein initial water input may be used for the term of hydrotherapy treatment, and it includes front panel adjustments whereby the user can effect selected blends of temperature and/or air mixture content. The apparatus consists of a shaped bath container that accommodates the lower legs and feet, and it includes a plurality of jets that simultaneously are directed to stimulate the soles of the feet, tops of feet, backs of lower legs and calves and the sides of the leg calves. The apparatus includes both a circulation pump for use in circulating jet water during hydrotherapy treatment as well as a smaller recirculating pump that is used to drain the system.

Therefore, it is an object of the present invention to provide hydrotherapy apparatus for the feet and lower legs that has greater efficiency and therapeutic effect.

It is also an object of the invention to provide hydrotherapy equipment that is economical, relatively portable and safe in operation.

Finally, it is an object of the present invention to provide a hydrotherapy unit for feet and legs that can effect maximum stimulation per unit time.

Other objects and advantages of the invention will be evident from the following detailed description when read in conjunction with the accompanying drawings which illustrate the invention.

DETAILED DESCRIPTION OF THE INVENTION

Figure 1:
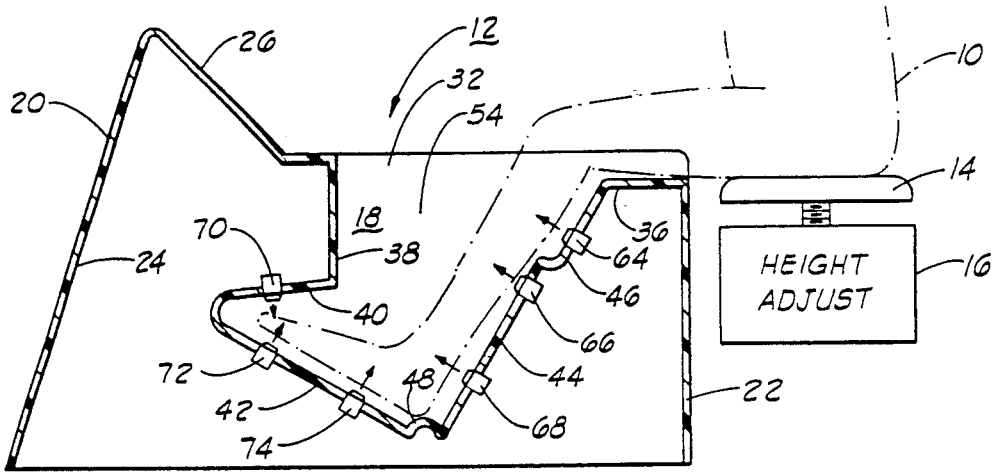
FIG. 1 is a side view in vertical section of the bath housing of the present invention.

FIG. 1 illustrates the manner in which a patient 10 uses a hydrotherapy unit 12 for stimulation of his feet and legs. The patient is preferably seated on a comfortable seat 14 having an adjustable base 16 so that his legs may be comfortably placed down within a well 18.

Figure 2:
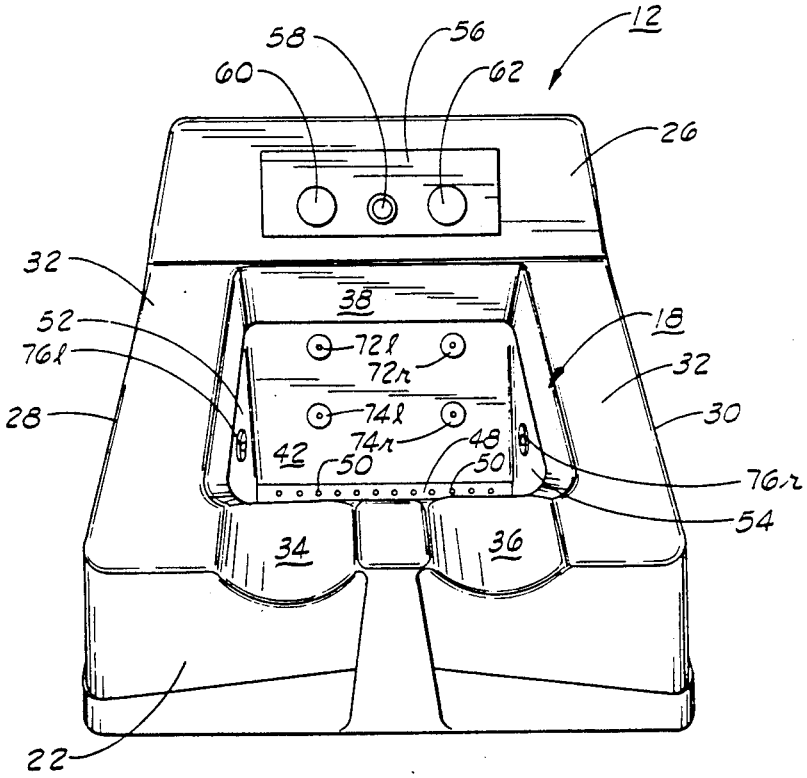
FIG. 2 is a front perspective viewing downward into the bath well.

The hydrotherapy device 12 is formed of fiberglass or other suitable plastic to outline a decorative body housing 20 that consists of a front panel 22, rear panel 24, top control panel 26 and side panels 28 and 30 (see also FIG. 2). A top panel 32 then defines a generally square well 18 downward within the body housing 20 while also having thigh indentures 34 and 36 formed therein for comfort purposes. The well 18 includes a forward wall 38 that bends 90 degrees into an upper foot wall 40 and a returning sole or lower foot wall 42. A rear wall 44 is formed to include a calf depression 46 and transverse lower point of well 18 is formed as a semicircular sump conduit 48 having a plurality of water withdrawal or drain holes 50. The well 18 is completed by opposite side walls 52 and 54.

The front panel controls are located on an escutcheon 56 and consist of a control switch 58 that controls air ON and air OFF. A left side valve control 60 controls the amount of air flow for mixture in the jetting liquid for the bottom jets (as will be described). In like manner, a right side valve control 62 provides control over air input to fluid for the upper extremity jets, as will be described. Controlling the amount of air allowed into the jet stream serves to vary the jet pressure as it is felt by the user.

The jet locations are shown in FIG. 1 for one side of well 18 and it should be understood that an identical jet array is disposed on the opposing side. Thus, a jet 64 is disposed immediately behind the patient's calf and jets 66 and 68 are directed towards the lower leg and ankle back. A jet 70 is aimed towards the top of the foot while jets 72 and 74 cover the sole of the foot. As shown in FIG. 2, the outside ankle of each leg is contacted by the jets 76 *l* and 76 *r*.

Figure 3:
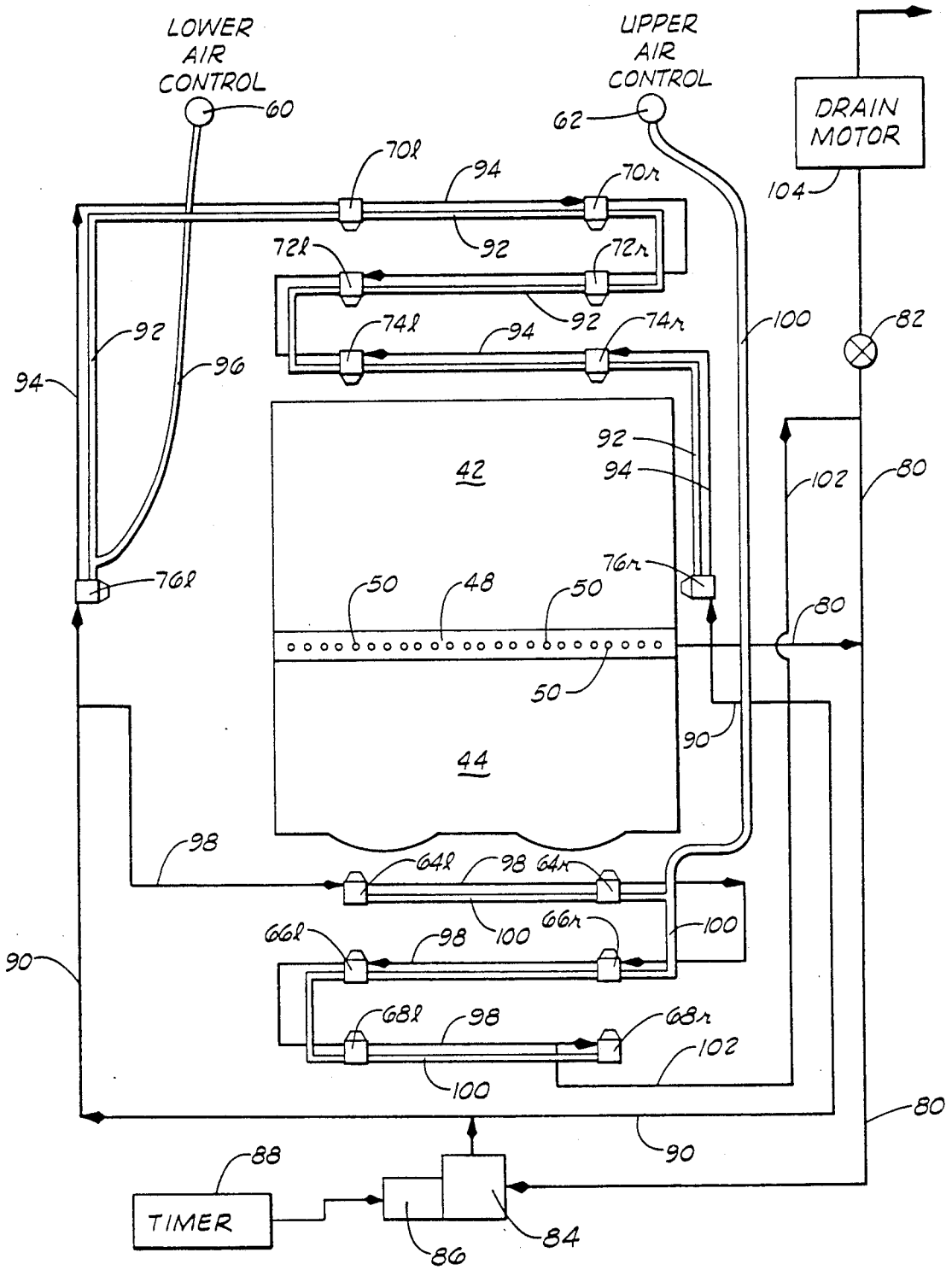
FIG. 3 is a schematic drawing illustrating the recirculating water flow with air control and the drain flow system.

Referring to FIG. 3, the air/water conduit routing is illustrated with air lines shown in open-line and water lines shown in solid-line. Thus, a main drain line 80 leads out from the bottom sump pipe 48 via drain holes 50. The main drain line 80 is connected to a control valve 82 that is closed during normal operation as well as to a pump 84 driven by motor 86. The pump 84 and motor 86 are a commercially available motor pump combination, a one horsepower type known as "MINI-JET" and available from Jacuzzi Corporation. A suitable timer 88 operable by the patient on the back panel can be used to set the duration of pump motor operation. Water output from pump 84 is then via conduit 90 to the jetting array. Thus, conduit 90 is applied to the respective side jets 76 1 and 76 r and these side jets are interconnected through the lower jets 70 *l* and 70 *r*, 72 *l* and 72 *r* and 74 *l* and 74 *r* by means of air conduit 92 and water conduit 94. Lower air control is via the front panel operated control valve 60 and air conduit 96 connected to conduit 92. The upper extremity jets are fed from water line 90 via water line 98 and upper air conduit 100 as connected to each of jets 64 *l* and 64 *r*, 66 *l* and 66 *r* and 68 *l* and 68 *r* with overflow water return via conduit 102 to the valve 82.

Each of the jets is a commercially available type of hydrotherapy jet obtained from Jacuzzi Corporation and air/water mixing takes place at the jet interface in accordance with selection of the air control. Controlling the amount of air flow then controls the amount of pressure emanating from the jet. After cessation of therapy usage or at designated times to change system water, the valve 82 can be opened and a drain motor 104 turned on to evacuate all water from the hydrotherapy unit 12. The drain motor 104 may be such as a one-fortieth horsepower motor pump which is commercially available from Little Giant Pump Co. of Oklahoma City, Oklahoma. A ground fault interruptor (not specifically shown) is included to isolate the electrical circuitry in the event of a short circuit.

The foregoing discloses a novel form of hydrotherapy unit that is particularly adapted for foot and leg stimulation utilizing a plurality of strategically placed jet outlets. The system represents an increased volume hydrotherapy apparatus that is especially advantageous for use in treating patients suffering from circulation deficiency, arthritis, muscle spasms, bursitis or tendonitis, sprains, strains and other problems of postoperative rehabilitation. The device is relatively compact and susceptible of portability while being relatively economical and reliable of construction. It should also be understood, that while the design has been particularly adapted for foot and leg therapy, it may also be utilized for hydrotherapy stimulation of other parts of the body, and the entire system including shaping of the treatment well might easily be redesigned for adaptation to particular body parts.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. Apparatus for foot and leg hydrotherapy, comprising:

a housing for receiving a person's feet and legs that defines a well having at least front and back walls, left and right side walls and a bottom, wherein said front wall is further formed to define a lower foot space by the front wall bending forward at approximately 90° to form a foot top wall and reversing at an acute angle to form said bottom;

a transverse sump with plural drain holes formed integrally with said housing bottom at the lowermost position;

a plurality of jets disposed at selected similar positions on each of the left and right side walls, the front wall, the bottom and the back wall;

a motor driven pump having inlet and outlet with the inlet connected to the transverse sump and the outlet connected to each of said jets;

a suction tube providing a source of air connected to each of said jets; and means for adjusting the amount of air drawn into the suction tube thereby to adjust the pressure of air/-water from the jets;

whereby a volume of water is maintained in circulation from the pump outlet to the jets, and through the sump for return to the pump inlet.

2. Apparatus as set forth in claim 1 which is further characterized by:

plural jets similarly disposed on right and left sides and positioned in the foot top wall.

3. Apparatus as set forth in claim 1 which is further characterized to include:

a drain valve actuatable between open and closed connected to the transverse sump;

a motor driven drain pump connected to said drain valve and operable to evacuate said volume of water when the drain valve is actuated open.

4. Apparatus as set forth in claim 1 wherein the plurality comprises:

fourteen air/water jets positioned with seven each on the right and left sides, the seven being disposed with one from the foot top wall, two from the bottom, two from the back wall directed at the lower leg and one from the back wall directed at the calf, and one from the respective side wall directed at the outer ankle.

5. Apparatus as set forth in claim 4 which is further characterized to include:

a drain valve actuatable between open and closed connected to the transverse sump;

a motor driven drain pump connected to said drain valve and operable to evacuate said volume of water when the drain valve is actuated open.

* * * * *